United States Patent [19]

Suzuki et al.

[11] 4,398,569

[45] Aug. 16, 1983

[54] DEVICE FOR SUPPORTING A HEALD FRAME IN A WEAVING LOOM

[75] Inventors: Hajime Suzuki, Anjo; Yoshifumi Umemura, Toyoake; Shigeru Tanaka, Kariya, all of Japan

[73] Assignee: Kabushiki Kaisha Toyoda Jidoshokki Seisakusho, Aichi, Japan

[21] Appl. No.: 278,072

[22] Filed: Jun. 29, 1981

[30] Foreign Application Priority Data

Jun. 30, 1980 [JP] Japan ..... 55-92519[U]

[51] Int. Cl.[3] ..... D03C 13/00

[52] U.S. Cl. ..... 139/88; 24/230.5 R; 248/340

[58] Field of Search ..... 139/88, 84, 82, 57; 24/230.5; 248/340

[56] References Cited

U.S. PATENT DOCUMENTS 1,202,503 10/1916 Fortier ..... 24/230.5 R 3,353,570 11/1967 Sweat ..... 139/88

FOREIGN PATENT DOCUMENTS 2201812 6/1973 Fed. Rep. of Germany ..... 139/57

*Primary Examiner*—James Kee Chi

*Attorney, Agent, or Firm*—Burgess, Ryan & Wayne

[57] ABSTRACT

A device for supporting a heald frame in a weaving loom comprises: a bracket which is fixed on the heald frame; and a hanger which is connected to a spring for supporting the heald frame or to a wire rope and which is coupled to the bracket. The bracket or the hanger has a cylindrical supporting shaft projecting therefrom, and the corresponding hanger or bracket has an engaging hole formed therein. The bracket and the hanger are turnably engaged with each other. At least one engaging projection is formed at the periphery of the hanger or bracket, and at least one U-shaped abutting projection having an engaging space is formed at the corresponding periphery of the bracket or hanger. The engaging projection is inserted into the engaging space, and the hanger is securely held by the bracket.

6 Claims, 9 Drawing Figures

DEVICE FOR SUPPORTING A HEALD FRAME IN A WEAVING LOOM

TECHNICAL FIELD

The present invention relates to a device for supporting a heald frame in a weaving loom, which heald frame actuates the shedding operation of warps.

PRIOR ART

Known is a device for supporting a heald frame in a weaving loom comprising: a bracket which is fixed to the heald frame; and a hanger which is connected to a spring for supporting the heald frame or to a flexible transmitting member, such as a wire or a rope, connected to a driving mechanism for driving the heald frame and which is coupled to the bracket.

In such a known device, an additional member is disposed in order to prevent the disengagement of the hanger from the bracket. The provision of such an additional member makes not only the construction of the device complicated but also the cost of the device expensive. In addition, since it is necessary to manually operate the additional member when the hanger is engaged with or disengaged from the bracket, the engaging and disengaging operations are troublesome.

SUMMARY OF THE INVENTION

An object of the present invention is to provide a device for supporting a heald frame in a weaving loom which secures the engagement between the bracket and the hanger while they are engaged with each other and which facilitates easy engagement and disengagement when the hanger is needed to be engaged with and disengaged from the bracket.

Another object of the present invention is to provide a device for supporting a heald frame in a weaving loom which has a simple construction so that it can be readily assembled and so that it can easily be operated when engagement and disengagement between the bracket and hanger takes place.

According to the present invention, the above-mentioned objects are achieved by a device which is characterized in that: either bracket or hanger has a supporting shaft projecting from the surface thereof, and the remaining member has an engaging hole formed therein, with which the supporting shaft turnably engages. The device is further characterized in that either bracket or hanger has at least one engaging projection formed at the periphery thereof, and the remaining member has at least one abutting projection formed in a U-shape at the periphery thereof which has an engaging space therein, the engaging projection being capable of being inserted into the engaging space.

BRIEF DESCRIPTION OF THE DRAWINGS

The present invention will now be explained in detail with reference to the accompanying drawings, wherein.

DETAILED DESCRIPTION OF THE INVENTION

Figure 1:
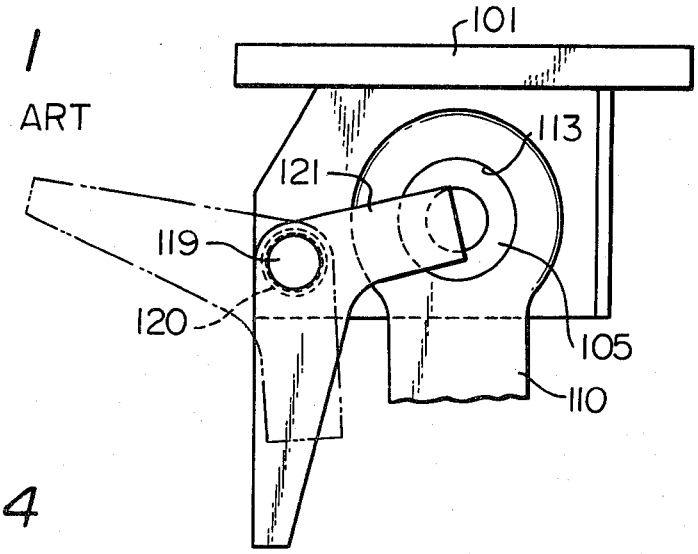
Fig. 1 PRIOR ART
FIG. 1 is an elevational view of a conventional device for supporting a heald frame.

Referring to FIG. 1, a conventional device for supporting a heald frame in a weaving loom will now be explained first. A bracket 101 which is fixed on a heald frame (not shown) has a supporting shaft 105 projecting therefrom, and a hanger 110 has an engaging hole 113 formed therein is turnably supported on the supporting shaft 105 by the engagement between the supporting shaft 105 and the engaging hole 113. An engaging lever 121 is turnably supported on a pin 119 which is projected from the bracket 101. A torsion spring 120 is inserted onto the pin 119, and one end of the torsion spring 120 is connected to the pin 119 and the other end of the torsion spring 120 is connected to the engaging lever 121. The engaging lever 121 is normally forced by means of the torsion spring 120 to a position illustrated in a solid line, so that one end of the engaging lever 121 engages with the front surface of the supporting shaft 105 and prevents the hanger 110 from being disengaged. When the engaging lever 121 is manually turned against the spring force of the torsion spring 120 to a position illustrated by a two-dot-and -a-dash line in FIG. 1, the hanger 110 is freely engaged with and disengaged from the bracket 105 by axially sliding it along the supporting shaft 105.

In the above-explained conventional device for supporting a heald frame, the engaging lever 121 and the torsion spring 120, which are installed separate from the bracket 101 and the hanger 110, are utilized to prevent the hanger 110 from being disengaged. Accordingly, the mechanism of this device is somewhat complicated, and as a result, its assembly is troublesome. In addition, the turning operation of the engaging lever, which is necessary to be manually done, is indispensable for engaging the hanger with and disengaging it from the bracket, and therefore, the engaging and disengaging operation cannot be readily performed.

Figure 4:
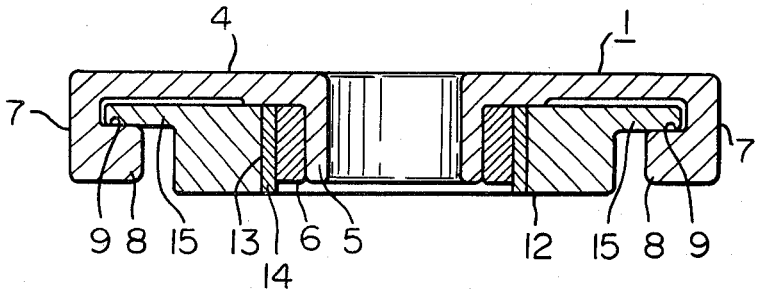
FIG. 4 is a cross sectional view taken along line IV—IV in FIG. 3.
Figure 2:
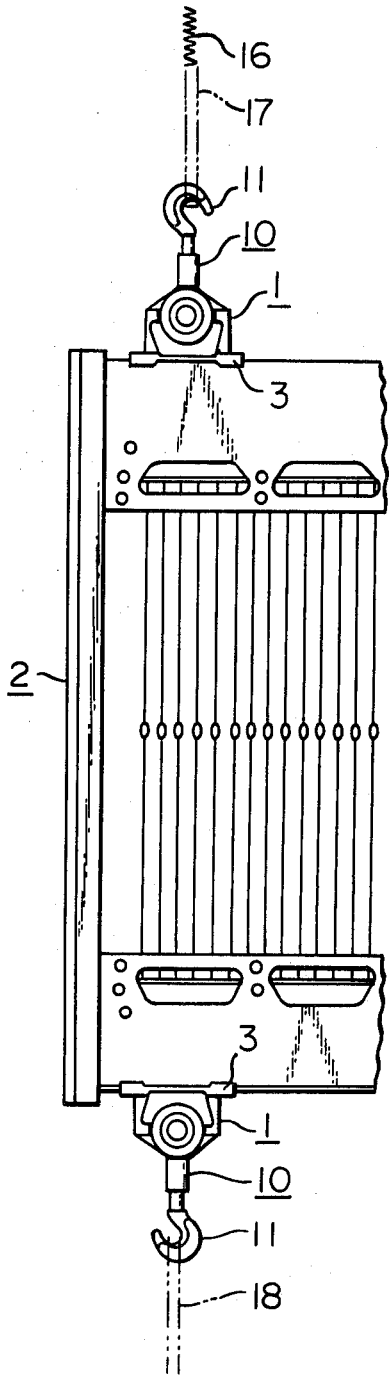
FIG. 2 is an elevational view of a part of a heald frame.
Figure 3:
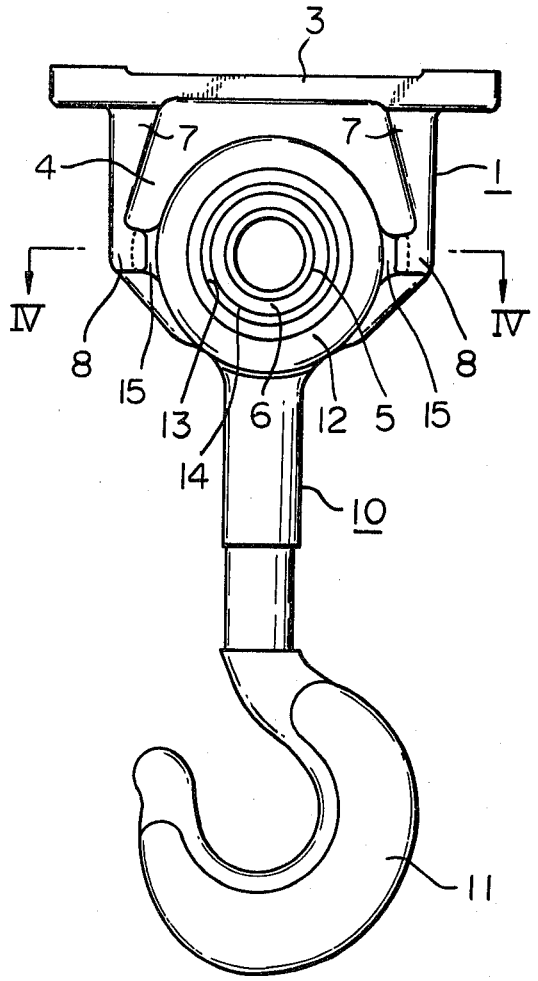
FIG. 3 is an enlarged partial elevational view of a device for supporting the heald frame illustrated in FIG. 2.

Some embodiments of the present invention will now be explained. Referring to FIG. 2, a heald frame 2 effects a shedding operation of warps and has brackets 1 fixed on the upper and lower frames thereof. As illustrated in FIG. 3, and 4 the bracket 1 is constituted with a securing portion 3 secured to the heald frame 2 (FIG. 2) by means of bolts (not shown) and a supporting plate 4 vertically extending from one end of the securing portion 3.

A supporting shaft 5 formed in a cylindrical shape is projected from the central front surface of the supporting plate 4. As illustrated in FIG. 4, a bearing metal 6 formed in a cylindrical shape is securely fitted onto the outer surface of the supporting shaft 5. A pair of projecting walls 7 are bent forwardly along the outer periphery of the supporting plate 4 so that they surround horizontal sides of the supporting shaft 5. Furthermore, a pair of abutting projections 8 are also inwardly bent from the front ends of the projecting walls 7 towards the supporting shaft 5, so that they form engaging spaces 9 between the supporting plate 4 and the abutting projections 8.

A hanger 10 illustrated in FIG. 3 has a hook 11 at the front end thereof, and it also has a hole 13 formed at the base portion thereof as illustrated in FIG. 4. A bearing metal 14 is securely fitted to the inside of the hole 13, and it turnably engages with the bearing metal 6 fixed on the outer surface of the supporting shaft 5 of the bracket 1. As illustrated in FIG. 3, a pair of engaging projections 15 horizontally project from the periphery of the base portion 12 of the hanger 10 and is capable of being inserted into the engaging space 9 of the bracket 1 as illustrated in FIG. 4.

Figure 5:
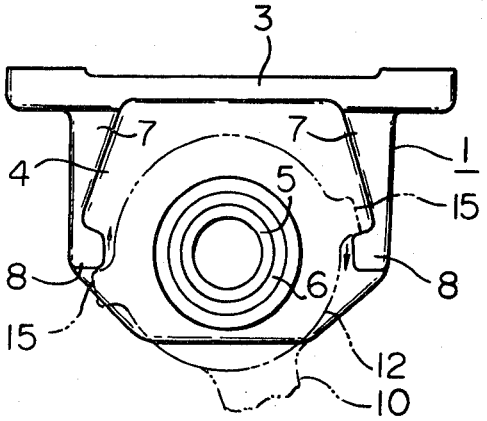
FIG. 5 is an elevational view illustrating an operation for engaging a hanger with a bracket.

When the hanger 10 is intended to be engaged with the bracket 1, as illustrated in FIG. 5, the engaging projections 15 of the hanger 10 are located near the abutting projections of the bracket 1, and the bearing metal 14 of the hanger 10 is engaged with the bearing metal 6 of the supporting shaft 5 formed on the bracket 1, and then the hanger 10 is axially pressed until it reaches the axially backward position. From this situation, the hanger 10 is turned clockwise as illustrated by arrows in FIG. 5 to a small angle. As a result, as illustrated in FIGS. 2 and 3, the engaging projections 15 of the hanger 10 inserts into the engaging spaces 9 of the bracket 1. In this case, if the leading edge of the engaging projection or the corresponding edge of the abutting projection is chamfered, the introduction of the engaging projection into the engaging space can be facilitated. Furthermore, it is preferable that a stop (not shown) is formed on the engaging projection or the abutting projection in order to limit the excessive turning of the hanger. The hanger 10 is prevented from disengagement due to the engagement between the engaging projections 15 and the abutting projections 8 of the bracket 1.

When the heald frame is used, the hanger 10 located at the upper side of the heald frame 2 is connected to a wire rope 17 which is connected to the hanging spring 16, as illustrated in FIG. 2. In addition, the hanger 10 located at the lower side of the heald frame 2 is connected to a wire rope 18 which is connected to the driving mechanism (not shown). Accordingly, as the driving mechanism operates, the heald frame 2 is vertically moved to and fro.

In a weaving loom, a plurality of heald frames are installed and are operated in a manner described above, so that shedding operation of warps takes place. Although the hanger 10 is mainly subjected to a intensive vertical pulling force, it is not subjected to any turning force. Accordingly, there is no risk that the hanger 10 is spontaneously turned about the supporting shaft. As a result, the disengagement of the hanger 10 from the supporting shaft 5 formed on the bracket 1 is completely prevented because of the engagement between the abutting projection 8 of the bracket 1 and the engaging projection 15 of the hanger 10.

When the hanger 10 is intended to be disengaged from the supporting shaft 5, the hanger 10 is turned counterclockwise to a position illustrated by a two-dot-and-a-dash line in FIG. 5, and then the hanger is disengaged from the supporting shaft 5 by axially sliding it.

The present invention is not limited to the embodiment explained above but can be modified in various ways within the technical scope of the present invention defined in the accompanying claims. Some modifications of the present invention will now be explained.

Figure 6:
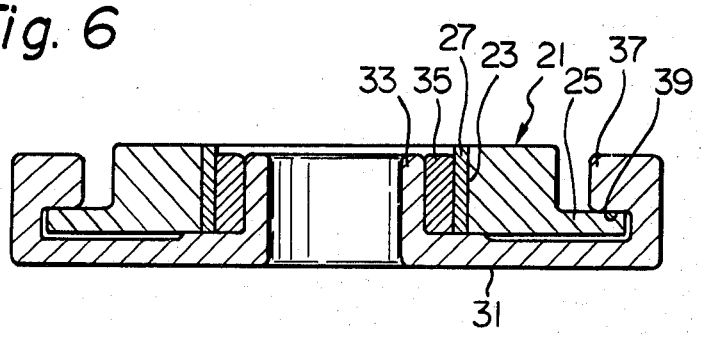
FIG. 6 is a cross sectional view, similar to FIG. 4, of a second embodiment.

In the second embodiment of the present invention illustrated in FIG. 6, a bracket 21 fixed on a headle frame (not shown) is formed in a planar shape. The bracket 21 has an engaging hole 23 formed at the center thereof and a pair of engaging projections 25 projecting outwards from the outer periphery thereof. A bearing metal 27 formed in a cylindrical shape is securely fitted to the inside of the engaging hole 23.

A hanger 31 has a cylindrical supporting shaft 33 projecting from the center thereof. A bearing metal 35 is securely fitted to the outside of the supporting shaft 33, so that the supporting shaft 33 is turnably supported in the engaging hole via the bearing metals 27 and 35. A pair of abutting portions 37 formed in a U-shape to form engaging spaces 39 is projected from the outer periphery of the hanger 10.

The construction of the second embodiment described above is symmetric with that of the first embodiment explained with reference to FIGS. 2 through 5, and further explanation, especially, the explanation of the operation, is believed to be unnecessary.

Figure 7:
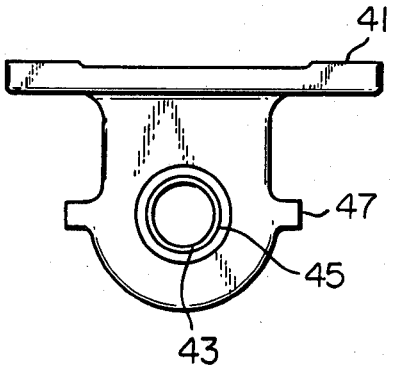
FIG. 7 is an elevational view of a bracket of a third embodiment.
Figure 9:
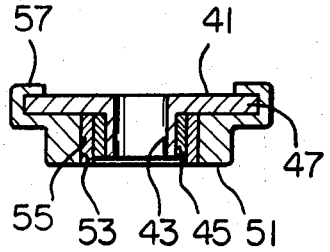
FIG. 9 is a sectional view, similar to FIG. 4, of the third embodiment.
Figure 8:
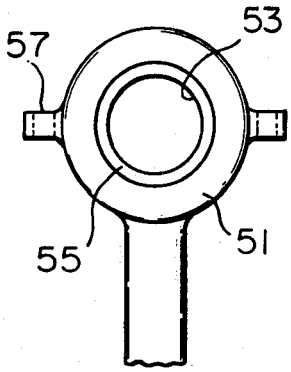
FIG. 8 is an elevational view of a hanger of the third embodiment.

The third embodiment illustrated in FIGS. 7 through 9 is a combination of the first and second embodiments. More specifically, a bracket 41 has a cylindrical supporting shaft 43 formed at the center thereof and is similar to the bracket 1 (FIGS. 2 through 4) of the first embodiment. A bearing metal 45 is similarly securely inserted onto the outer surface of the supporting shaft 43. The bracket has a pair of engaging projections 47 formed at the periphery thereof, which is similar to the engaging projections 25 (FIG. 6) of the second embodiment, instead of the U-shaped abutting projections 8 (FIG. 4) used in the first embodiment. A hanger 51 has an engaging hole 53 formed at the center thereof which is similar to the engaging hole 13 (FIG. 4) of the first embodiment. A bearing metal 55 is securely fitted to the inside of the engaging hole 53. A pair of abutting projections 57 formed in a U-shape are projected from the outer periphery of the hanger 51 similar to the abutting projections 37 (FIG. 6) of the second embodiment.

The operation of the third embodiment illustrated in FIGS. 7 through 9 is similar to the operations of the above-explained first and second embodiments, and accordingly, its further explanation is believed to be unnecessary.

In the above-described embodiments, the number of both the engaging projections and the abutting projections is two. However, the number is not limited to two. More specifically, the number may be one or more if the hanger can be securely held to the bracket while they engage with each other.

The present invention can achieve the following unexpected advantages.

A. The hanger can readily be engaged with and disengaged from the bracket only by turning the hanger by a limited small angle. In addition, the engaging and disengaging operations can be carried out by means of a single hand. This is because, when the hanger needs to be engaged with the bracket, the engaging hole formed in the hanger or the bracket is engaged with the supporting shaft projecting from the bracket or the hanger, and then, the hanger is turned by the limited angle in order to insert the engaging projection into the engaging space, so that the hanger is securely held by the bracket. When the hanger needs to be disengaged from the bracket, after the hanger is turned to loosen the engagement, the hanger is moved axially and it is readily removed from the bracket.

B. While the heald frame is operating, the hanger is prevented from undesirably disengaging from the bracket, because the engagement between engaging projection and the abutting projection secures the engagement of the hanger with the bracket.

C. Since any additional mechanism for engaging a hanger with or disengaging it from a bracket is not disposed separate from the hanger or bracket, the construction of the device is simple, and the device can easily be assembled.

We claim:

1. A device for supporting a heald frame in a weaving loom comprising: a bracket which is fixed on the heald frame; and a hanger which is connected to a spring for supporting said heald frame or to a flexible transmitting member connected to a driving mechanism for driving said heald frame and which is separatably coupleable to said bracket, wherein, one member of said bracket and hanger has a supporting shaft projecting from the surface thereof, and the other member of said bracket and hanger has an engaging hole formed therein, with which said supporting shaft turnably engages; and one member of said bracket and hanger has at least one engaging projection formed at the periphery thereof, and the other member of said bracket and hanger has at least one abutting projection formed in a U-shape at the periphery thereof which has an engaging space therein, said engaging projection being capable of being inserted into said engaging space.

2. A device for supporting a heald frame in a weaving loom according to claim 1, wherein the U-shaped abutting projection is formed at the periphery of one member of said bracket and hanger, which is provided with said supporting shaft.

3. A device for supporting a heald frame in a weaving loom according to claim 1, wherein the U-shaped abutting projection is formed at the periphery of one member of said bracket and hanger, which has said engaging hole formed therein.

4. A device for supporting a heald frame in a weaving loom according to claim 2, wherein the U-shaped abutting projection is formed at the periphery of said bracket which is provided with said supporting shaft, and said engaging projection is formed at the periphery of said hanger.

5. A device for supporting a heald frame in a weaving loom according to claim 2, wherein the U-shaped abutting projection is formed at the periphery of said hanger which is provided with said supporting shaft, and said engaging projection is formed at the periphery of said bracket.

6. A device for supporting a heald frame in a weaving loom according to claim 1, wherein the number of both said engaging projection and said abutting projection is plural.

* * * * *